US007999206B2

(12) United States Patent
Norris

(10) Patent No.: US 7,999,206 B2
(45) Date of Patent: Aug. 16, 2011

(54) METHOD AND SYSTEM FOR SORTING OF EXTENDED CAPABILITY MAIL

(75) Inventor: Michael O. Norris, Colleyville, TX (US)

(73) Assignee: Siemens Industry, Inc., Alpharetta, GA (US)

( * ) Notice: Subject to any disclaimer, the term of this patent is extended or adjusted under 35 U.S.C. 154(b) by 13 days.

(21) Appl. No.: 12/381,678

(22) Filed: Mar. 13, 2009

(65) Prior Publication Data

US 2009/0230031 A1 Sep. 17, 2009

Related U.S. Application Data

(60) Provisional application No. 61/036,637, filed on Mar. 14, 2008.

(51) Int. Cl.
*B07C 5/00* (2006.01)

(52) U.S. Cl. ..... 209/584; 209/900; 700/223

(58) Field of Classification Search ..... 209/559, 209/583, 584, 900; 700/223–226
See application file for complete search history.

(56) References Cited

U.S. PATENT DOCUMENTS

| | | | | |
|---|---|---|---|---|
| 4,691,912 | A * | 9/1987 | Gillmann | 271/10.02 |
| 5,109,987 | A | 5/1992 | Daboub et al. | |
| 5,508,818 | A | 4/1996 | Hamma | |
| 6,555,776 | B2 | 4/2003 | Roth et al. | |
| 6,576,857 | B1 * | 6/2003 | De Leo et al. | 209/584 |
| 6,685,184 | B2 * | 2/2004 | Tufekci et al. | 271/270 |
| 6,994,220 | B2 | 2/2006 | Schererz et al. | |
| 7,282,658 | B2 * | 10/2007 | Hanson et al. | 209/584 |
| 7,663,072 | B2 * | 2/2010 | Conard et al. | 209/584 |
| 7,687,737 | B2 * | 3/2010 | Zimmermann et al. | 209/583 |
| 2002/0139726 | A1 | 10/2002 | Roth et al. | |
| 2004/0007510 | A1 * | 1/2004 | Kechel | 209/584 |
| 2004/0040898 | A1 | 3/2004 | Kechel | |
| 2004/0159592 | A1 * | 8/2004 | McLaughlin et al. | 209/584 |
| 2007/0144948 | A1 | 6/2007 | Worth et al. | |
| 2008/0251429 | A1 * | 10/2008 | Norris et al. | 209/584 |

FOREIGN PATENT DOCUMENTS

DE 19705891 C1 3/1998

OTHER PUBLICATIONS

Nico Meintker, Edwin Bland, Lelan Warren; "Improved Pickoff Mechanism for Mail Feeder"; U.S. Appl. No. 12/186,082, filed Aug. 5, 2008, pp. 1-11.

Simon Jan Krause, Rajeev Dwivedi; "Improved Pickoff Mechanism for Mail Feeder"; U.S. Appl. No. 12/186,108, filed Aug. 5, 2008, pp. 1-13.

Jan Simon Krause, Bryan Stone, John Day, Uwe Maertin, Rajeev Dwivedi; "Improved Pickoff Mechanism for Mail Feeder"; U.S. Appl. No. 12/186,122, filed Aug. 5, 2008, pp. 1-11.

* cited by examiner

*Primary Examiner* — Joseph C Rodriguez
(74) *Attorney, Agent, or Firm* — Filip A. Kowalewski

(57) ABSTRACT

A method for sorting flat mail pieces includes the steps of; sorting automation letters on the first pass of a two pass operation, then sorting extended capability letters after all automation mail has been sorted on pass one of a two pass operation. A control system identifies which pieces are automation and which pieces are extended capability (EC) mail during the first pass and re-feeding the mixed letters in a second pass.

8 Claims, 3 Drawing Sheets

METHOD AND SYSTEM FOR SORTING OF EXTENDED CAPABILITY MAIL

This application claims priority of U.S. provisional application No. 61/036,637 filed Mar. 14, 2008.

FIELD OF THE INVENTION

The invention relates to postal sorting systems and methods as currently operated by the U.S. Postal Service (USPS).

BACKGROUND OF THE INVENTION

Daboub, et al. U.S. Pat. No. 5,109,987 May 5, 1992 describes a multilevel mail sorting machine of a type which is now in widespread use in various forms, with specific machines known as DBCS and MLOCR. For years, the United States Postal Service (USPS) has been sorting letter mail using automation equipment. The size of mail sorted on this equipment is limited to a specification listed in the Domestic Mail Manual (DMM) and generally meets the criteria listed below.

Each letter-size piece must be rectangular and:

a) For height, no more than 6⅛ or less than 3½ inches high.

b) For length, no more than 11½ or less than 5 inches long.

c) For thickness, no more than ¼ inch or less than (1) 0.007 inch thick if no more than 4¼ inches high and 6 inches long; or (2) 0.009 inch thick if more than 4¼ inches high or 6 inches long, or both d) Weight not to exceed 3.3 ounces.

The aspect ratio (length of the mail piece divided by height) must be between 1.3 and 2.5 inclusive.

Recently the USPS has deployed equipment which is capable of sorting mail up to 0.5 inch thick and which can weigh up to 6.0 ounces. Mail which fits the increased standard is categorized as Expanded Capability (EC) mail and is sorted on a Delivery Bar Code Sorter Input/Output Sub-System (DIOSS EC) and DBCS EC machines manufactured by Siemens Postal Automation. Using the DIOSS EC machine, EC mail is sorted in a separate operation from the automation compatible mail.

At present, EC mail is only sorted to the Delivery Unit (DU) level. At the DU, the EC mail along with the residual manual mail is manually sorted to carrier route by a clerk, and then cased to delivery point sequence by a letter carrier. Compared to automation mail, manual mail, which includes EC mail in this example, is costly to sort. In contrast, automation compatible mail can be sorted to a finer sort depth, using multiple automated processes, to a Delivery Point Sequence (DPS) using efficient automation equipment, thus eliminating costly manual casing operations.

The original design of the DIOSS EC machines runs a smaller gap between the automation letters than the gap setting for EC letters. The gap setting is determined by the sort plan. If an automation sort plan is selected, the control computer downloads the gap setting to the feeder firmware. If an EC sort plan is selected, the control computer likewise downloads the gap setting to the feeder firmware, but for an EC sort plan, the control computer downloads a larger gap setting. Due to the geometry of the belt path, running a larger gap for EC mail is required if the leading mail piece is thick and the trailing mail piece is thin by comparison. Without the larger gap, the thin mail piece will not keep in pinch between the belts and rollers, causing slippage and/or jams. The result is that the machine throughput is significantly lower for EC mail than for automation mail due to the larger gap setting.

The USPS does not mix EC mail with automation mail during sorting because it wants automation mail to sort as fast as possible. It is undesirable to make 95% of the mail suffer the slower throughput penalty that is required for sorting EC mail. This invention provides a method for sorting mail previously classified as EC letters with the automation letters to a delivery point sequence in a manner that does not degrade the automation letter productivity.

SUMMARY OF THE INVENTION

A method for sorting flat mail pieces includes the steps of; sorting automation letters on a first pass of a two pass mail sorting operation, then sorting extended capability letters after all automation mail has been sorted on pass one of the two pass operation. A control system identifies which pieces are automation mail and which pieces are extended capability (EC) mail during the first pass, and then the mixed letters are re-fed in a second pass of the two pass sort.

According to a preferred form of the invention, a method for sorting flat mail pieces includes the step of initializing an automated pinch-belt sorting machine wherein letters are fed one at a time to a pinch belt conveyor by a mechanized feeder, scanned for destination information, and then diverted to stacker pockets according to a sort scheme implemented by a computerized control system. Automation letters are sorted using the sorting machine in a first pass of a two pass mail sorting operation using a first gap setting. Extended capability mail is sorted using the sorting machine in the first pass separately from the automation mail using a second gap setting that is greater than the first gap setting. A computerized control system tracks the number of automation mail pieces and the number of extended capability mail pieces sorted to each pocket, and tracks the order in which automation mail pieces and extended capability mail pieces are sorted to each pocket. For purposes of then invention this means, for example, that the control system records that in pocket #N, the first 100 mail pieces are automation mail and the last 25 are EC mail. After the first pass sort, mail is swept from each pocket including both automation mail and extended capability mail pieces while maintaining the order in which mail pieces were sorted to that pocket, as is typical in a second pass mail sort. The mail is then re-fed, one pocket at a time, including both automation mail and letter mail, to the sorting machine in a second pass of the sort scheme. The computerized control system uses the first gap setting as a series of automation mail pieces from each pocket are sorted, and uses the second gap setting as a series of the extended capability mail pieces from each pocket are sorted.

The invention further provides a system for carrying out the foregoing method which includes a letter sorting machine of the pinch belt type, a control system including software which operates the sorting machine to carry out the described steps. These and other aspects of the invention are described further in the detailed description that follows.

It is to be understood that terms used in the present invention, such as "stackers", should be given their meanings recognized in the postal sorting art, if applicable, not more general definitions found in dictionaries. For purposes of the invention, "gap setting" refers to the spacing between consecutive mail pieces of the same type (automation or EC) as determined by the timing of pickoff at the feeder and transport speed on the pinch belt conveyor. A "stacker" is one of a number of mechanisms associated with a pocket in the stacker section of the sorting machine which uses a gate to divert selected mail pieces from a stream passing by the gate into the pocket.

For purposes of the invention including the claims, "Automation mail" in its most broad sense refers to mail which meets all of a set of mail physical standards used by the mail sorting machine in question, and "extended capability mail" is mail which does not fully comply with the standards but which can be run on that machine with increased spacing between successive mail pieces on the pinch belt conveyor. The DMM standards listed above are one form of standard defining automation mail, but "DMM standard" for purposes of the invention should be understood to include any successor, alternative or functional equivalent to such a standard. Extended capability mail more specifically refers to mail which fails to comply with all of the standards, but which can be effectively sorted on the sorting machine but with greater separation between successive EC mail pieces on the conveyor that is used between automation mail pieces. As such, the EC mail passes through the sorting machine at the same speed as the automation mail, but its throughput is lower because of the greater separation between mail pieces.

For purposes of the invention, the term "mail pieces" refers to the type of flat mail subject to multi-pass sorting. "Flat mail" means substantially two dimensional mail pieces wherein the thickness is small compared to the length and width. This should not be confused with flats", a type of mail piece considerably larger and thicker than letter mail, including magazines and catalogs. The method of the invention could be applied to sorting of flats in some cases. On the other hand, parcels are three dimensional mail pieces (not "flat" as that word is used above as an adjective) and as such the method of the invention is not applicable, nor is technology developed for parcel sorting of interest for purposes of letter sorting due the three-dimensional nature of parcels.

BRIEF DESCRIPTION OF THE DRAWINGS

In the accompanying drawings, where like numerals denote like elements.

DETAILED DESCRIPTION

Figure 1:
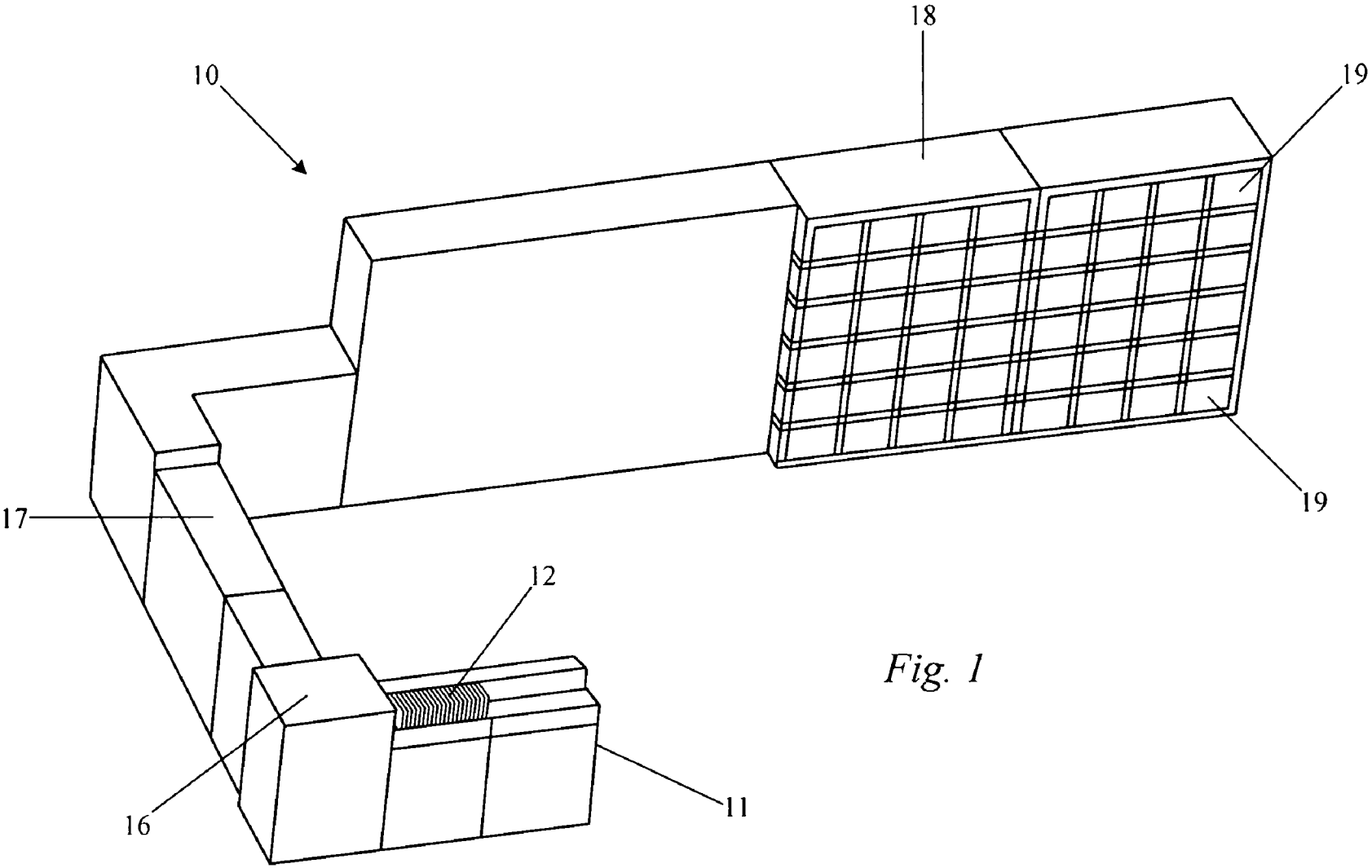
FIG. 1 is a schematic side view of a DBCS-EC sorting machine used in the present invention.
Figure 3:
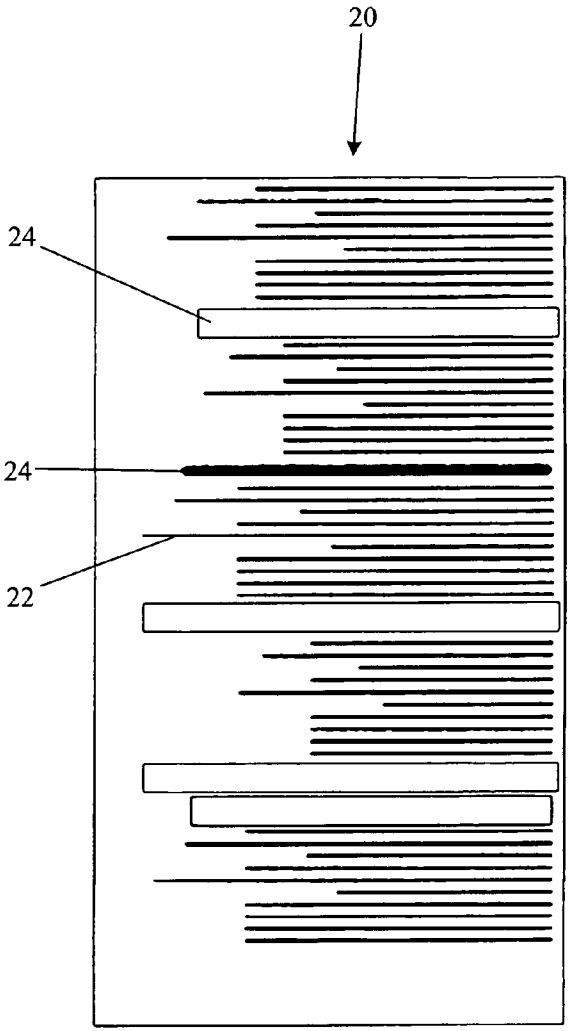
FIG. 3 is an overhead view of mail sorted to a stacker pocket after a second pass sort according to the invention.

Automation letters arrive at a processing plant sorted to a delivery unit level by upstream processing equipment. EC letters are likewise sorted to the delivery unit level by upstream processing equipment. Mail destined for a delivery unit is sent to an EC Delivery Bar Code Sorter (DBCS machine) 10 to be delivery point sequenced in a two pass operation. Referring now to FIG. 1, mail sorting machine 10 includes a feeder 11 where a stack 12 of flat mail pieces are loaded edgewise for sorting. Examples of such feeders are disclosed in commonly assigned Luebben et al. U.S. Pat. No. 6,679,491, the disclosure of which is incorporated herein by reference. Feeder 11 uses a pickoff mechanism 16 that removes the endmost mail piece from the stack 12 and feeds it to a pinch belt conveyor in a transport section 17 of the sorter. The conveyor conveys the mail pieces to a scanner such as a bar code scanner or an optical character recognition (OCR) apparatus that reads destination information from the mail piece and transmits it to a control computer that stores the destination information and identifies the pocket 19 in the stacker section 18 where the mail piece is to be directed.

Figure 2:
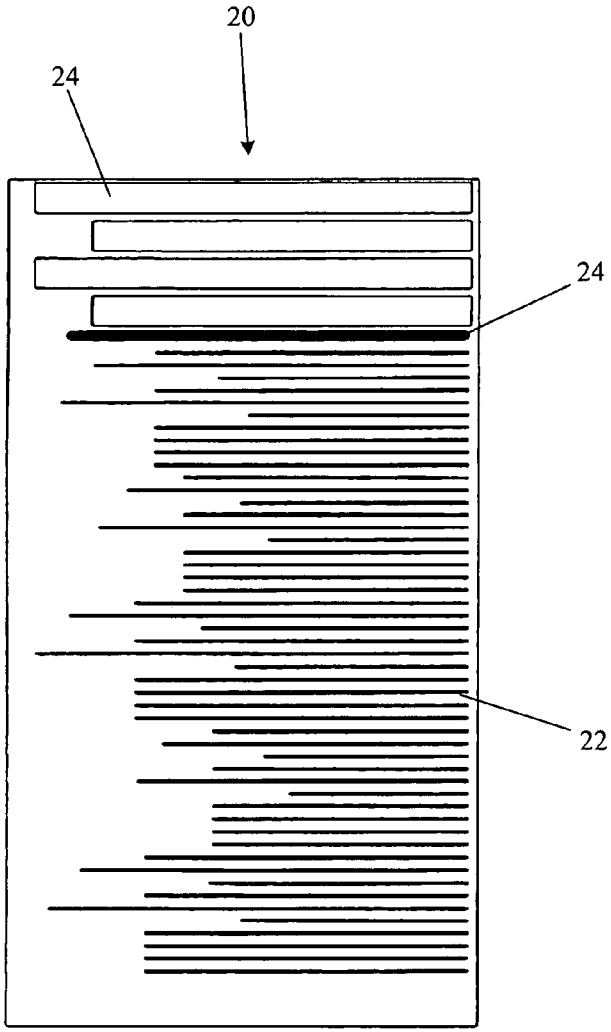
FIG. 2 is an overhead view of mail sorted to a stacker pocket after a first pass sort according to the invention.

Step one of the preferred method of the invention provides that all automation letters be sorted first. This is usually most efficient because the automation letters are ready for two pass sorting sooner than EC mail. After all automation mail is sorted, an operator signals the controls via the human-machine interface that letters entering the machine now are EC letters. In a preferred form of the invention, the automation mail complies with the DMM standards set forth above, and the EC mail pieces each have one or both of: a weight greater than 3.3 ounces and a thickness greater than ¼ inch. The EC mail will run at the slower throughput rate with larger gaps. The gap is created at the feeder pick-off belts controlled by a servo motor. It is measured from the trailing edge of the first piece picked-off to the leading edge of the next piece being picked-off. Automation mail gap is preferably set at 100 mm and for EC mail the gap is changed to 140 mm. In general, the EC gap setting is at least 10 mm greater than the automation mail gap setting. The feeder pick-off algorithm produces the lower throughput for EC mail by inserting a larger gap between mail pieces. The pinch belts always run at a constant speed of 4 meters/sec, no matter what type of mail is being sorted. After all the EC letters have run, the EC letters will be in the backs of the pockets as shown in FIG. 2. The control system knows how many automation letters and how many EC letters that it sent to each of the pockets.

Mail is fed on the second pass in pocket order. That is, all the mail from pocket one is fed first, and then pocket two, and then pocket three and so on. The control system counts the number of pieces being picked-off from pocket one. The system knows how many automation pieces it sent to pocket one during first pass. When the count is reached, the system sends a command to the feeder firmware to pick off mail pieces that follow with a larger gap setting. Once the number of pieces of EC mail have been picked-off, the control system sends the command to the feeder firmware to return to the original gap setting for next pocket's automation mail. This process is repeated for every pocket until all pockets have been sorted in the second pass. The end result is that automation and EC letters are delivery point sequenced together with automation mail running at automation throughputs and EC mail running at EC throughputs. There is no loss of productivity for the automation letters.

In a preferred form of the invention, the control system in the second pass stores in memory and uses the results of the first pass to determine when to switch over to the EC mail gap setting. This is done by maintaining in memory a table (data record) of the contents of each pocket at the end of the first pass. This need not be a detailed record of each mail piece and its destination, but rather a per pocket record of how many EC mail pieces and how many automation mail pieces were sorted to that pocket, and in what order the groups appear. FIG. 2 illustrates this for a stacker pocket 20. The automation mail pieces 22 are sorted first, occupying a majority of the pocket as would be typical, followed by EC mail 24 at the entry end of the pocket. The control system keeps count of the number of pickoff cycles, or the number of passing mail pieces by means such as photocells deployed on the pinch belt path near the pickoff 16. Sensors such as photocells can be used to confirm the count and the gap setting so that variations can be detected and corrected. An example of sensors deployed at a pickoff mechanism can be found in commonly assigned U.S. Ser. No. 12/186,108, which is incorporated by reference below. Such sensors can also be used to detect whether an EC mail piece is present by measuring the dimensions and weight of each passing mail piece so that the gap between that mail piece and the one behind it can be adjusted accordingly. See also commonly assigned Norris et al. U.S. Patent Application 20080251429, Oct. 16, 2008, incorporated by reference herein, which analyzes the physical characteristics of flat articles being sorted to determine which downstream operations the articles should be processed with next. Length, height, width and stiffness information are received from sensors, and the data is analyzed to determine if the mail piece is automation compatible, extended capability or manual letter, or a flat. The weight of the mail piece can be estimated based on its dimensions by methods known in the art so that the control system can determine or verify that the mail piece is an EC mail piece.

In the second pass, as is known the art, the mail must be sorted pocket by pocket, the control system tracking the contents of each pocket according to the RADIX sort method. In the second pass, the mail pieces are fed in the order shown in FIG. 2 in two groups, automation mail first and EC mail last. This is preferred but not required. The EC mail could be fed first or even part way through, with groups of automation mail both ahead of and behind it. The essential feature is that the different types of mail form one or more series with a beginning and end known to, or detectable by, the control system. For the latter purpose, the control system could make use of markers or divider cards between groups of mail, but this is not a preferred solution in that a large number of cards would be needed and handled. The control system could also use sensor inputs as described above to determine when the gap setting should be changed over. A further option would be to label the last mail piece in each series with a scannable marker such as an RFID tag identifying it as the end of a series of automation or EC mail pieces, so that a change in gap setting is then needed. By measures such as the foregoing the method can be practiced by (1) counting the number of mail pieces in each group, (2) looking for a marker that indicates the end of one series and the beginning of the next, or (3) determining the properties of each passing mail pieces to make the same determination.

The gap is created at the feeder pick-off belts controlled by a servo motor. It is measured from the trailing edge of the first piece picked-off to the leading edge of the next piece being picked-off. Under the DMM standard set forth above, the automation mail gap is set at 100 mm and for EC mail the gap is changed to 140 mm. The feeder pick-off algorithm produces the lower throughput for EC mail by inserting a larger gap between mail pieces. The pinch belts of the conveyor run at a constant speed, for example 4 meters/sec.

Another variable that affects throughput is the thickness of the mail being picked off. EC mail is typically thicker and takes more time for the pickoff belts to strip the piece from the end of the stack. This is a function of the feeder conveyor bottom belt control that moves the stack of mail to the pick off location. If the mail is thin, for example 0.010 inch, the bottom belt only travels a small distance. When the piece is 0.5 inch thick, then the belt has to travel farther and it takes more time to move the next piece into its pick-off position. A number of means have been suggested in commonly assigned applications for better controlling the pickoff performance when thick and thin mail pieces are encountered, and the use of such improved pickoff mechanisms can further improve efficiency of the sorting process using the method of the invention. See commonly assigned U.S. patent application Ser. No. 12/186,082, filed Aug. 5, 2008; U.S. patent application Ser. No. 12/186,108, filed Aug. 5, 2008 and U.S. patent application Ser. No. 12/186,122, filed Aug. 5, 2008. Use of one or more of these pickoff systems is preferred in the present invention for preventing problems from arising at transition points between automation mail and EC mail, i.e. when the one series has just ended and the next mail piece fed is of the next series, and also for improving feeding of EC mail as a series of EC mail pieces are being sorted.

Figure 4:
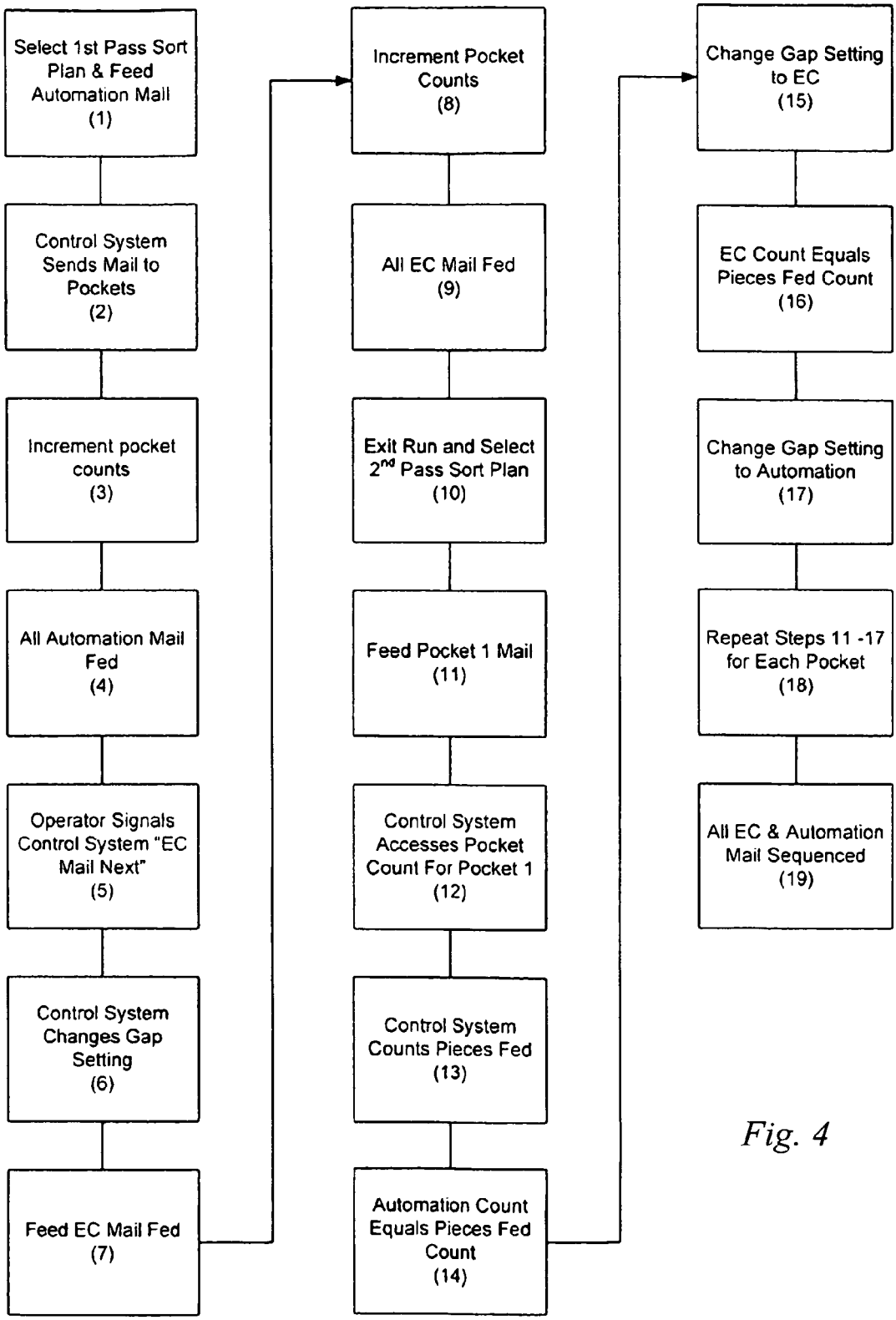
FIG. 4 is a flow chart of a sorting run according to the invention.

FIG. 4 illustrates a preferred sequence of steps of the invention. In (step (1) the control system of the sorting machine is initialized by selection of a sorting plan and then execution of the first pass sort as described above. Automation mail is sent to pockets based on the selected sort plan in (step (2) and pocket counts are maintained by the control system (step (3). Once all automation mail is fed (step 4), the operator switches the system to receive EC mail (step (5), which involves changing the gap setting (step (6). EC mail is then run and pocket counts are again incremented with the break point between automation mail and EC mail saved as the total number of automation mail pieces sorted in the first pass (steps (7),(8)). Once all EC mail is fed and sorted to a pocket in (step (9), an operator informs the control system to exit the run and then selects a second pass sort plan (step (10). Mail from the first pocket is then fed and sorted (step (11). The control system accesses the pocket count from the first pass to determine where EC mail will appear (step (12). The control system increments a pieces fed counter until the counter equals the number of automation mail pieces sorted to that pocket in the first pass (steps (13) and (14)). Then it switches to the larger gap setting (step (15). Once the EC mail count for that pocket from the first pass equals the total number of EC mail pieces fed from the first pass (step (16), the gap setting is reset to handle automation mail (step (17). Steps 11-17 are repeated (step (18) for each of the pockets until all pockets have been sorted in the second pass (step (19), (end)). These steps could vary if additional control features are implemented. For example, in the second pass the control system and sorter are called upon to switch from automation mail to EC mail and back again "on the fly". Sensor inputs could be read at (step (14) to verify where the break point between automation mail and EC mail lies. The steps would likewise vary if EC mail were fed first in the first pass, instead of the automation mail.

Although several embodiments of the present invention have been described in the foregoing detailed description and illustrated in the accompanying drawings, it will be understood by those skilled in the art that the invention is not limited to the embodiments disclosed but is capable of numerous rearrangements, substitutions and modifications without departing from the spirit of the invention. Such modifications are within the scope of the invention as expressed in the appended claims.

The invention claimed is:

1. A method for sorting flat mail pieces includes the steps of initializing an automated pinch-belt sorting machine wherein letters are fed one at a time to a pinch belt conveyor by a mechanized feeder, scanned for destination information and then diverted to stacker pockets according to a sort scheme implemented by a computerized control system;

sorting automation letters using the sorting machine in a first pass of a two pass mail sorting operation using a first gap setting;

sorting extended capability mail using the sorting machine in the first pass separately from the automation mail using a second gap setting that is greater than the first gap setting;

tracking with a computerized control system the number of automation mail pieces and the number of extended capability mail pieces sorted to each pocket, and the order in which automation mail pieces and extended capability mail pieces are sorted to each pocket;

sweeping mail from each pocket including both automation mail and extended capability mail pieces mail while maintaining the order in which mail pieces were sorted to that pocket; and re-feeding the mail from each pocket including both automation mail and extended capability mail to the sorting machine for a second pass of the sort scheme, wherein the computerized control system uses the first gap setting as a series of automation mail pieces from each pocket are sorted and uses the second gap setting as a series of the extended capability mail pieces from each pocket are sorted.

2. The method of claim 1, wherein the automation mail has physical characteristics that meet a standard wherein each mail piece:

is no more than 6⅛ or less than 3½ inches high, no more than 11½ or less than 5 inches long, no more than ¼ inch thick or less than 0.007 inch thick if no more than 4¼ inches high and 6 inches long; or 0.009 inch thick if more than 4¼ inches high or 6 inches long, or both, has weight not exceeding 3.3 ounces, an aspect ratio between 1.3 and 2.5 inclusive, and extended capability mail meets the same standards except that each extended capability mail piece may be up to 0.5 inch thick and can weigh up to 6.0 ounces.

3. The method of claim 2, wherein each extended capability mail piece has one or both of: a weight greater than 3.3 ounces and a thickness greater than ¼ inch.

4. The method of claim 1, wherein the mail pieces comprise letter mail.

5. The method of claim 3, wherein the sorting machine is one of an EC-MLOCR and a EC-DBCS machine.

6. The method of claim 5, wherein the two pass sort results in automation and extended capability mail sorted together to delivery point sequence.

7. The method of claim 1, wherein the second gap setting is at least 10 mm greater than the first gap setting.

8. The method of claim 1, wherein the feeder comprises a pickoff mechanism that removes mail pieces one at a time from one end of an edgewise stack and feeds them to the pinch belt conveyor.

* * * * *